US005779030A

United States Patent [19]

Ikegami et al.

[11] Patent Number: 5,779,030

[45] Date of Patent: Jul. 14, 1998

[54] KEY BOARD

[75] Inventors: Masahomi Ikegami; Hobeom Park, both of Suwon-si, Rep. of Korea

[73] Assignee: Samsung Electro-Mechanics Co., Ltd., Kyongki-do, Rep. of Korea

[21] Appl. No.: 757,792

[22] Filed: Nov. 27, 1996

[51] Int. Cl.[6] ..... H01H 13/70

[52] U.S. Cl. ..... 200/344; 200/341

[58] Field of Search ..... 200/344, 345, 200/341, 520

[56] References Cited

U.S. PATENT DOCUMENTS

| | | | |
|---|---|---|---|
| 4,952,762 | 8/1990 | Koyanagi | 200/395 |
| 5,003,140 | 3/1991 | Abell, Jr. et al. | 200/349 |
| 5,448,210 | 9/1995 | Shigetaka et al. . | |
| 5,512,719 | 4/1996 | Okada et al. . | |
| 5,602,715 | 2/1997 | Lempicki et al. | 200/345 |

*Primary Examiner*—David J. Walczak

*Attorney, Agent, or Firm*—Lowe Hauptman Gopstein & Berner

[57] ABSTRACT

A key board for a notebook type computer invention includes a switching part (260) disposed between a key frame (210) and a backing board (201), for electrical actuation upon pressing of actuation rubbers (240). A link plate (220) is disposed between the key frame (210) and a key top (250). The link plate (220 includes a first link part (221) and a second link part (222) integrally connected together through a connecting plate (230) to enable the key top to perform smooth upward and downward actuations. The link plate disposed between the key top and key frame is integrally formed; therefore, even when the user presses only one part of the key top, the entire key top is smoothly actuated due to the smooth and parallel actuations of the link plate. The vertical strokes of the key top are maintained at a constant level due to the integral link plate, and a plurality of actuation rubbers are integrally formed on a sheet so as to make the key board thin.

5 Claims, 9 Drawing Sheets

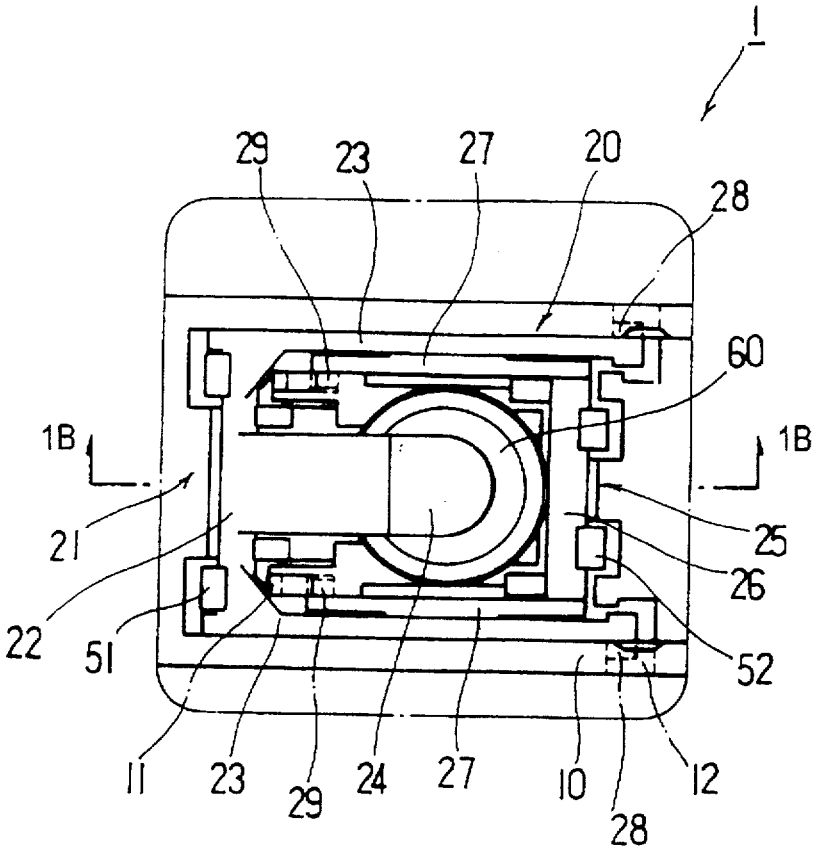
FIG.1 ( A ) (PRIOR ART)
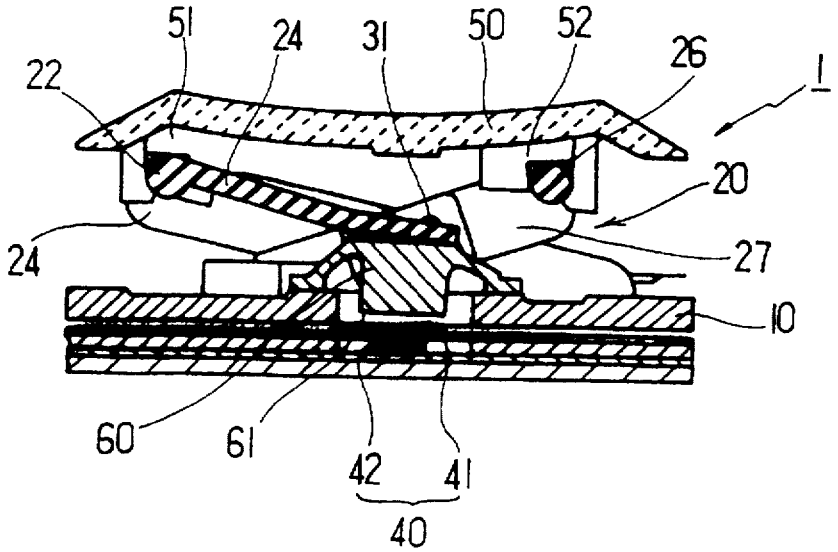
FIG.1 ( B ) (PRIOR ART)

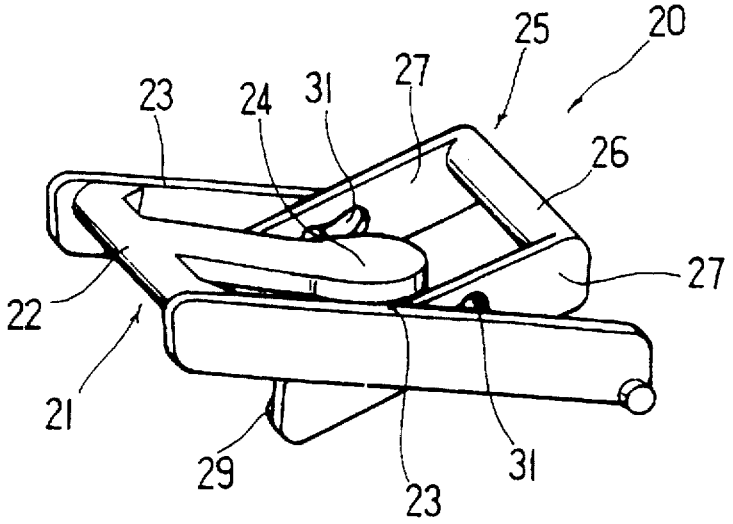
FIG.2 ( A ) (PRIOR ART)
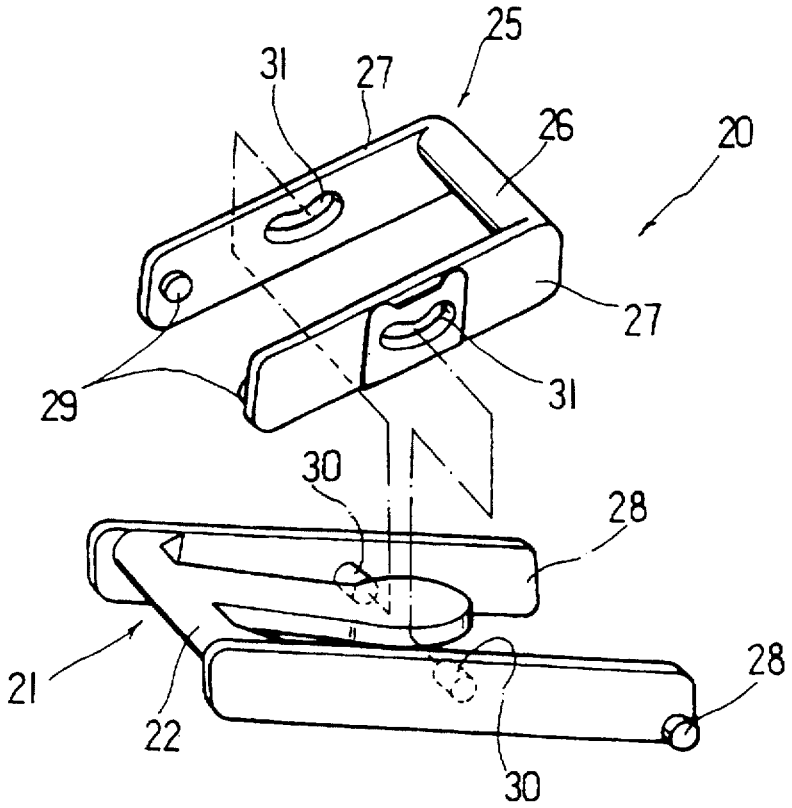
FIG.2 ( B ) (PRIOR ART)

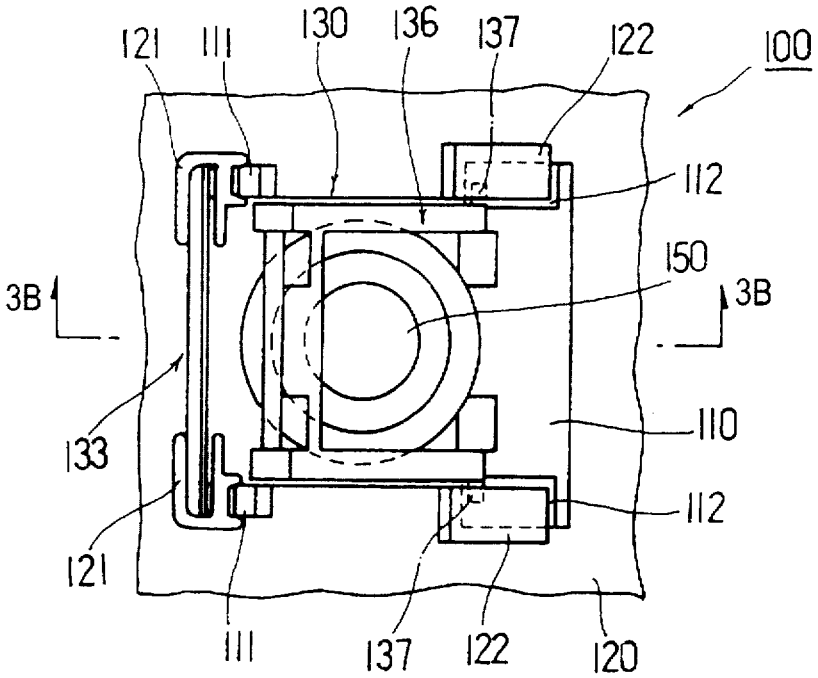
FIG.3 ( A ) (PRIOR ART)
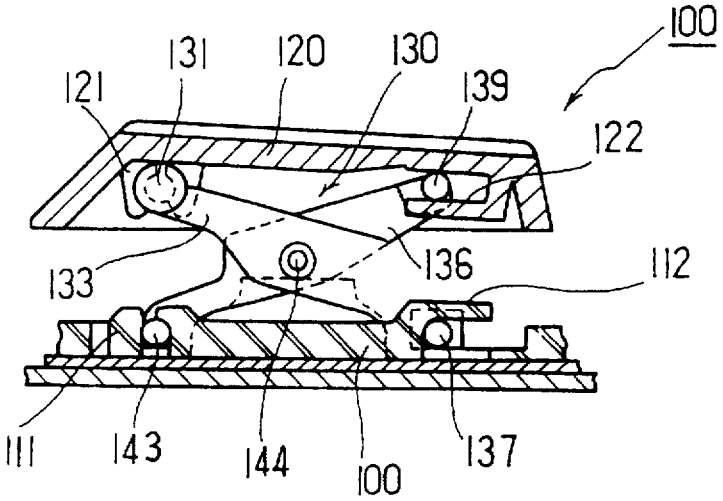
FIG.3 ( B ) (PRIOR ART)

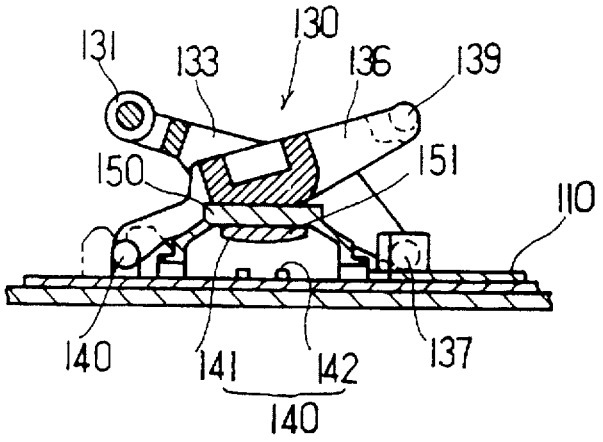
FIG.4 ( A ) (PRIOR ART)
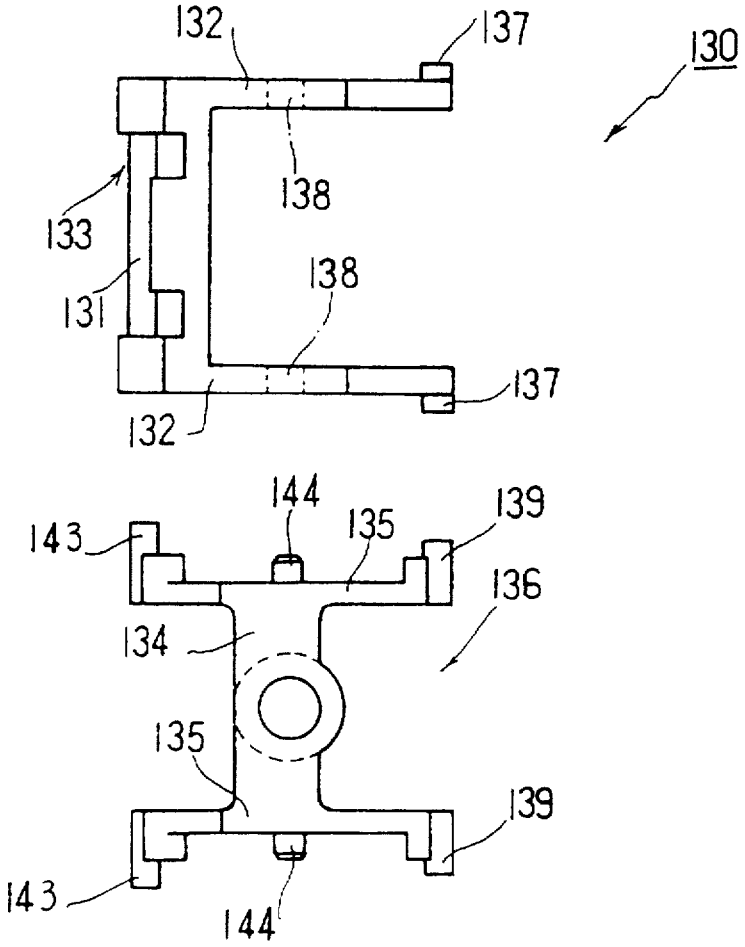
FIG.4 ( B ) (PRIOR ART)

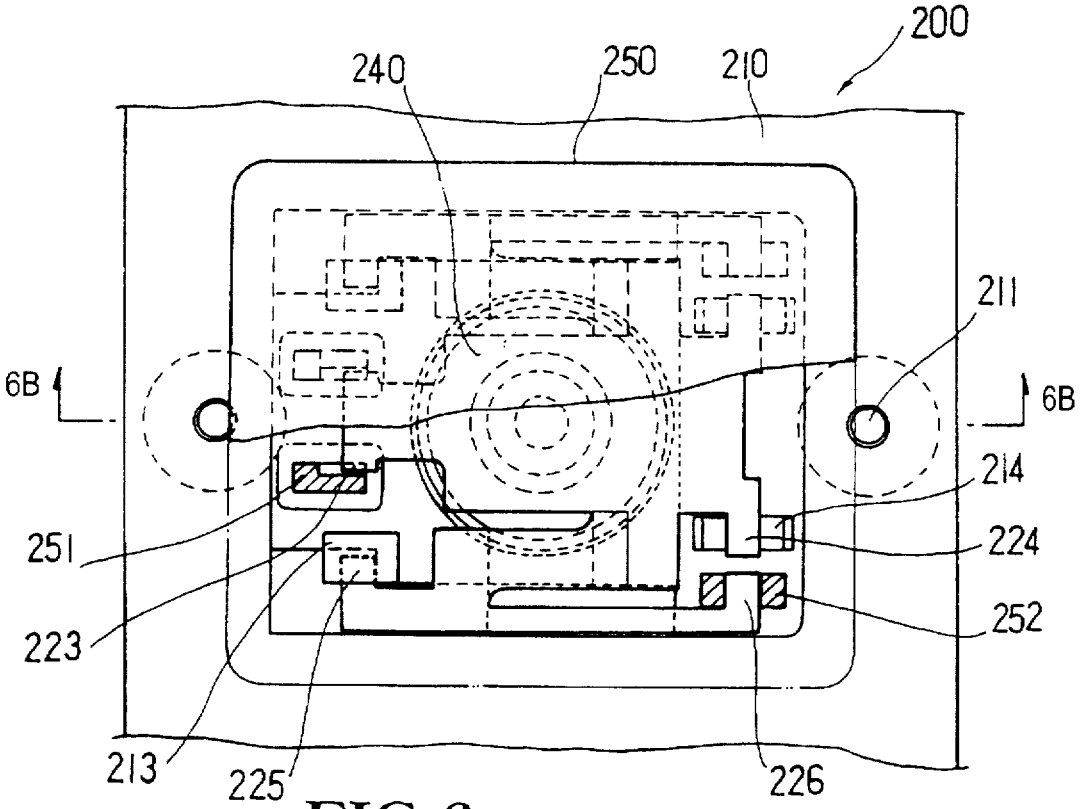
FIG.6 ( A )
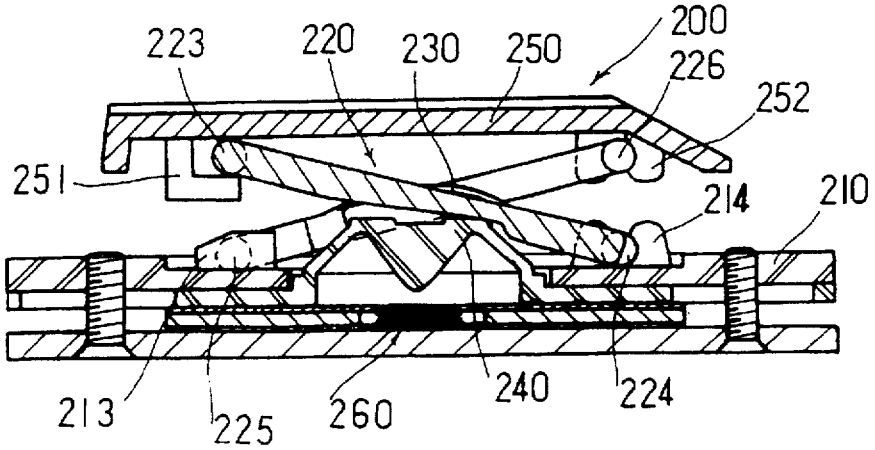
FIG.6 ( B )

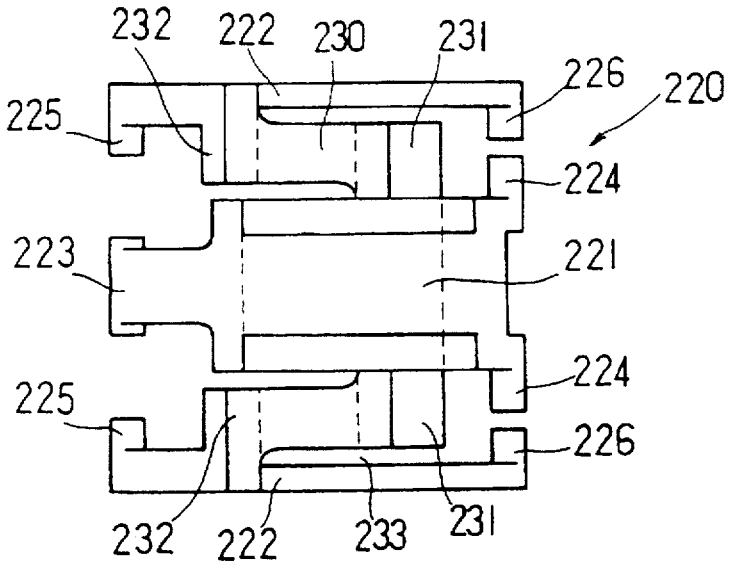
FIG.7 ( A )
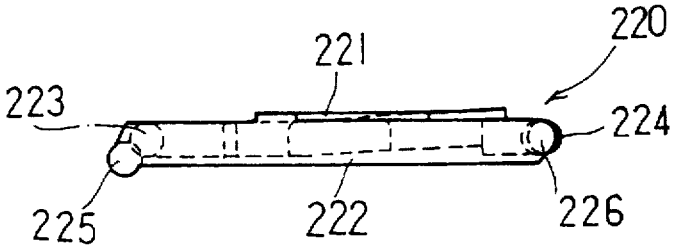
FIG.7 ( B )
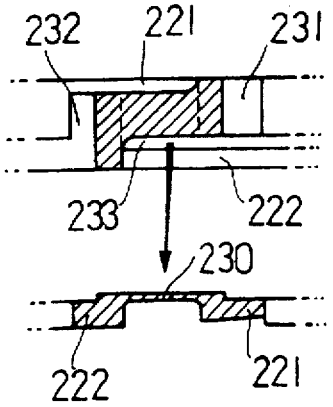
FIG.7 ( C )

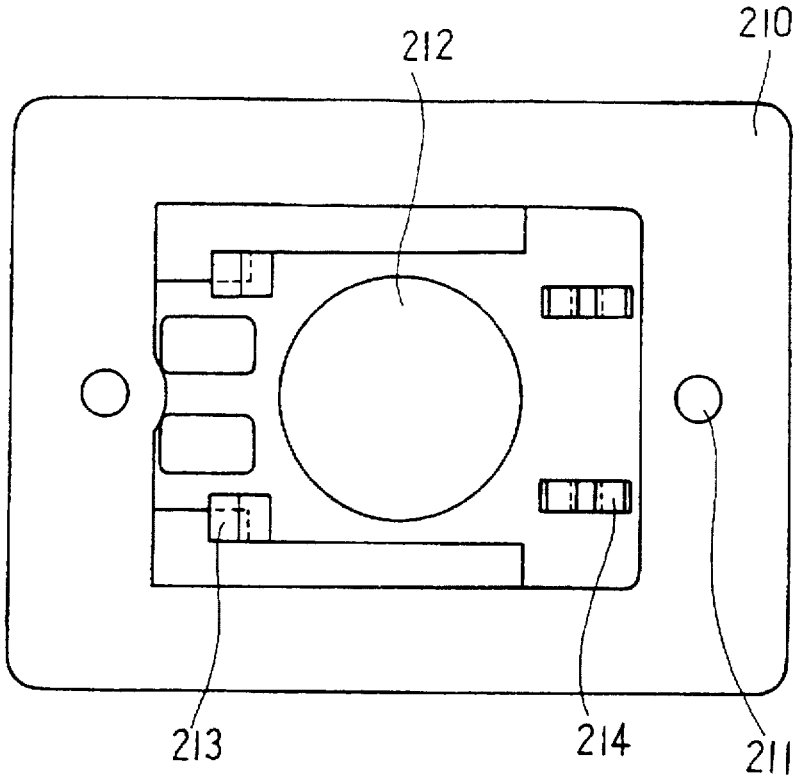
FIG.8 ( A )
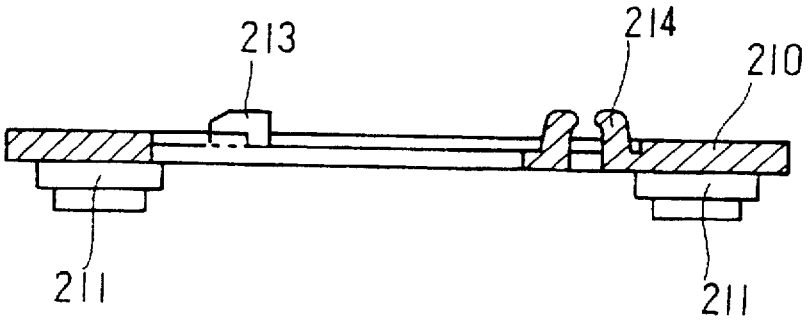
FIG.8 ( B )

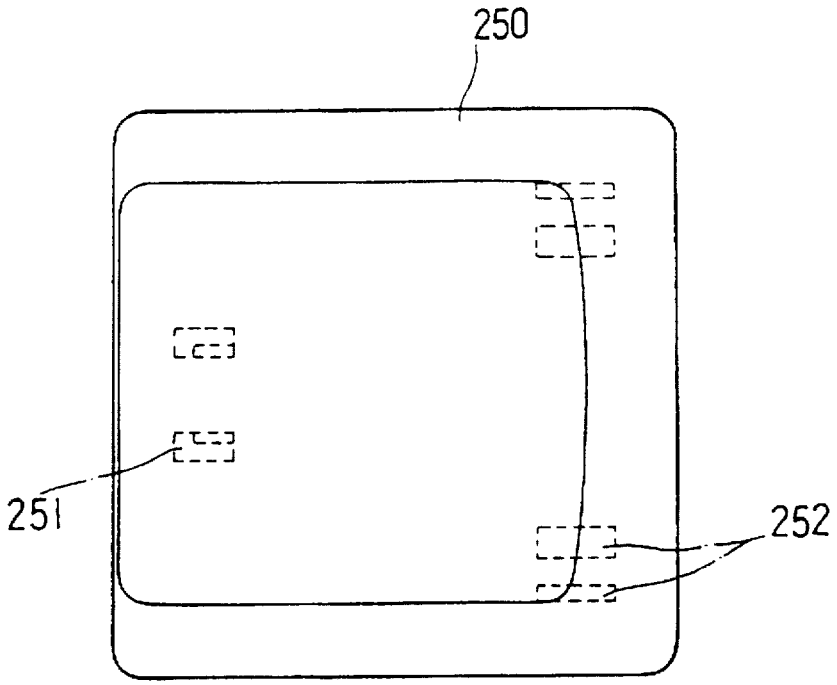
FIG.9 ( A )
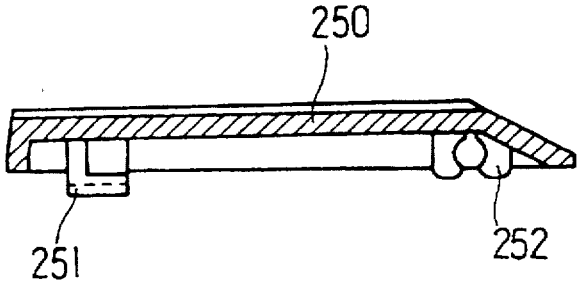
FIG.9 ( B )

KEY BOARD

FIELD OF THE INVENTION

The present invention relates generally to key boards for use in a personal computer or a word processor and, more particularly, in the thin a notebook type computer.

DESCRIPTION OF THE PRIOR ART

Generally, known key boards for computers includes a guide member beneath a key top, so that repetitive vertical actuations of the key top is possible. In a housing or holder disposed below the guide member, a switching de vice is made to be contacted during the pressing of the key top, so that electrical actuations occur. Further, there is installed an actuation rubber (elastomeric material), so that the key top would be actuated up and down.

However, in the general key board having the guide member, there are limits in the vertical strokes of the key top and in the overall height of the key board due to the guide member (the minimum height is 8 mm, and the stroke is 3 mm or more). Therefore, the generally known key board cannot be used in the thin key board for the notebook type computer.

In an attempt to solve the above described problems, there have been proposed key boards in which the vertical movements of the key top is carried out by the help of a link member or a hinge member.

That is, U.S. Pat. Nos. 5,488,210 and 5,512,719 disclosed thin key boards, each using a link member or a hinge member.

In U.S. Pat. No. 5,488,210, the key board is constituted as follows. That is, as shown in FIGS. 1 and 2, a link member 20 is disposed between a key top 50 and a housing 10 of a key board 1. Between the link member 20 and the housing 10, there is installed a switch part 40 in which a movable contact 41 and a fixed contact 42 electrically contact together. Above the switch part 40, there is disposed a contact rubber 60 which is made of an elastomeric material and which has a protuberance 61.

Further, as shown in FIG. 2, the link member 20 includes a first link part 21 and a second link part 25 coupled together. The first link part 21 includes a first supporting part 22 and two supporting members 23, the first supporting part 22 having an action piece 24 and being connected between the two supporting members 23. The second link part 25 includes a second supporting part 26 and two supporting members 27, the second supporting part 26 being connected between the two supporting members 27.

A pair of first supporting pieces 28 are integrally formed at the outer leading end portions of the supporting members 23 of the first link part 21, and a pair of hinge pieces are formed at the inner middle positions of the supporting members 23. A pair of curved slots 31 are formed at the middle positions of the supporting members 27 of the second link part 25, and a pair of second supporting pieces 29 are formed at the inner leading end portions of the supporting members 27.

Under the bottom of the key top 50 and at a side of the housing 10, there are installed first guide pieces 51 and 11, so that the first supporting part 22 of the first link part 21 and the second supporting pieces 29 of the second link part 25 can be rotatably and slidably coupled, respectively. At another end of the housing 10 and under the key top 50, there are installed second guide pieces 52 and 12, so that the second supporting part 26 of the second link part 25 and the first supporting pieces 28 of the first link part 21 can be rotated and slidden.

The hinge pieces 30 of the first link part 21 are slidably inserted into the curved slots 31 of the second link part 25.

In the key board 1 constituted as described above, if the user presses the key top 50, the key top 50 descends owing to the link member 20. At the same time, the action piece 24 of the first supporting part 22 of the first link part 21 presses the contact rubber 60. Then the protuberance 61 of the contact rubber 60 makes the movable contact 41 of the switch part 40 contact to the fixed contact 42, and therefore, the key board 1 is electrically actuated, with the result that the key top 50 is guided upward smoothly by the link member 20, thereby completing downward and upward movements of the key top 50.

Under this condition, the first supporting part 22 of the first link part 21 and the second supporting part 26 of the second link part 25, which are respectively engaged to the first and second guide pieces 51 and 52 of the key top, pivot during the upward and downward movements of the key top 50. At the same time, the first and second supporting pieces 28 and 29 of the first and second link parts 21 and 25, which are engaged with the first and second guide pieces 11 and 12 of the housing 10, are slidden during the upward and downward movements of the key top 50. The hinge pieces 30 of the first link part 21, which are inserted into the curved slots 31 of the second ink part 25, are also sudden during the upward and downward movements of the key top 50.

In this key board 1, however, the link member 20 is constituted such that the first and second link parts 21 and 25 mutually cross as separate members. Further, the contact rubber 60 which makes it possible for the key top 50 to perform upward and downward movements is separately installed. Therefore, due to the separate assembling of the link parts 21 and 25, the overall assembling process steps are increased, and the constitution of the key board is complicated. Consequently, the workability and productivity are significantly aggravated, and particularly, the total height of the key board is increased, with the result that the key board touch sensation is aggravated.

Meanwhile, the key board of U.S. Pat. No. 5,512,719 is as shown in FIGS. 3 and 4. Referring to these drawings, a hinge member 130 is connected between a key top 120 of a key board 100 and a holder 110 so as to make the upward and downward movements of the key top 120 smooth. Upon the holder 110, there are installed: a switch member 140 consisting of a movable contact 141 and a fixed contact 142; and a guide supporting part 150 for making the switch member 140 actuate from above.

Further, the hinge member 130 includes: a first hinge part 133 consisting of a first supporting part 131 and a pair of supporting parts 132, the first supporting part 131 being connected integrally with the pair of the supporting parts 132; and a second hinge part 136 consisting of a second supporting part 134 and a pair of supporting parts 135, thereby crossingly connecting the first hinge part 133 and the second hinge part 136.

At outer leading ends and at the middle positions of the supporting members 132 of the first hinge part 133, there are formed first hinge pieces 137 and guide slots 138.

At outer leading ends and at the middle positions of the supporting members 135 of the second hinge part 136, there are formed second supporting pieces 139 and 143 and protuberances 144 in an integral form.

Further, at a side of the holder 110 and under the bottom of the key top, there are installed first guide pieces 121 and 111 with which the first supporting part 131 of the first hinge part 133 and the second supporting pieces 143 of the second hinge part 136 are rotatably engaged. Under the bottom of the key top 50 and at another end of the holder 110, there are installed second guide pieces 122 and 112 with which the first supporting pieces 139 of the second hinge part 136 and the first supporting pieces 137 of the first hinge part 133 are slidably actuated.

Meanwhile, the protuberances 144 of the second hinge part 136 are inserted into the guide slots 138 of the first hinge part 131 in a rotatable form.

In the above described key board 100, if the user presses the key top 120, the key top 120 descends in parallel with the hinge member 130 to press the guide supporting part 150. At the same time, the inner protuberance 151 of the guide supporting part 150 makes the movable contact 141 of the switching member 140 contacted to the fixed contact 142, with the result that the key board 100 electrically operates.

Under this condition, during the upward and downward actuations of the key top 120, pivoting and sliding actuations are performed by the first supporting part 131 of the first hinge part 133 which is fitted to the first and second guide pieces 121 and 122 (which are installed under the bottom of the key top 120), and by the first supporting piece 139 of the second hinge part 136. At the same time, pivoting and sliding actuations are performed by the second supporting pieces 143 of the second hinge part 136 which is fitted to the first and second guide pieces 111 and 112 (which are installed at the both sides of the holder 110), and by the first supporting pieces 137 of the first hinge part 133. Meanwhile, rotating actuations are performed by the protuberances 144 of the second hinge part 136, which are inserted into the guide slots 138 of the first hinge part 131.

In this key board 100, the hinge part 130 is formed such that hinge parts 133 and 136 are connected as separate components. Further, the guide supporting part 150 is separately installed on the key board 100, so that the key top 120 can be actuated up and down. Further, a separate assembling step for assembling the hinge parts 133 and 136 is added, and therefore, the total assembling process steps are increased. Further, as in the other prior art, the structure of the key board is complicated, with the result that the workability and the productivity are lowered. Further, the height of the key board is hopelessly increased, and therefore, the touching sensation is aggravated.

SUMMARY OF THE INVENTION

It is an object of the present invention to provide a key board in which a link plate disposed between a key top and a key frame is integrally formed, and therefore, even if the user presses only one part of the key top, the key top is smoothly actuated owing to the smooth and parallel actuations of the link plate. Further, the vertical strokes of the key top is maintained at a constant level owing to the integral link plate, and a plurality of actuation rubbers are integrally formed on a sheet so as to make the key board thin. Further, the constitution of the key board is simplified owing to the integral link plate so as to render the manufacture of the key board easy, and so as to reduce the assembling process steps, thereby improving the workability and productivity.

In achieving the above object, the key board according to the present invention includes:

- a key top with first guide pieces and second guide pieces installed thereon;
- a key frame installed opposingly facingly with the key top, and with guide pieces formed thereon;
- a plurality of actuation rubbers arranged integrally on an actuation rubber sheet, for making upward and downward actuations of the key top and the actuations of a switching part possible;
- the switching part causing a movable contact and a fixed contact to be contacted by the help of the actuation rubber; and
- a link plate disposed between the key top and the key frame, and having a connecting plate for integrally connecting a first link part and a second link part.

More specifically, the present invention relates to a key board which includes: a switch part connected upon pressing an actuation rubber disposed between a key frame and a backing board; and a link plate integrally coupled with first and second link parts between the key frame and the key top, for smoothly guiding and supporting the vertical actuation of a key top. Thus the link plate is integrally formed, and therefore, even if the user presses a part of the key top during the vertical movement of the key top, the vertical actuation of the key top becomes smooth and efficient owing to the smooth and parallel actuation of the link plate. Further, the vertical strokes of the key top due to the integral link plate are maintained at a constant level. Further, owing to an actuation rubber sheet having a plurality of actuation rubbers, it becomes easy to make the key board thin. Further, the integral link plate provides a simple constitution, and therefore, the manufacture becomes easier. Further, the assembling process steps for the key board are reduced, with the result that the workability and the productivity are improved.

BRIEF DESCRIPTION OF THE DRAWINGS

FIG. 1A is a plan view showing the structure of a conventional key board;

FIG. 1B is a sectional view taken along a line 1B—1B of FIG. 1A;

FIG. 2A illustrates link members coupled together for guiding the upward and downward actuations of the key top in the key board of FIG. 1;

FIG. 2B is an exploded perspective view of the link members of FIG. 2A;

FIG. 3A is a plan view showing the structure of another conventional key board;

FIG. 3B is a sectional view taken along a line 3B—3B of FIG. 3A;

FIG. 4A illustrates hinge members coupled together for guiding the upward and downward actuations of the key top in the key board of FIG. 3;

FIG. 4B is an exploded view of the hinge members of FIG. 4A;

FIG. 6A is a plan view showing the key board according to the present invention;

FIG. 6B is a sectional view taken along a line 6B—6B of FIG. 6A;

FIG. 7A is a plan view of an integral link member for guiding and supporting the upward and downward actuations of the key top in the key board according to the present invention;

FIG. 7B is a frontal view of the link plate of the key board according to the present invention;

FIG. 7C illustrates the critical portion, i.e., a connecting plate of the link plate of the key board according to the present invention;

FIGS. 8A and 8B are plan and frontal views of the key frame of the key board according to the present invention; and FIGS. 9A and 9B are plan and frontal views of the key top of the key board according to the present invention.

DETAILED DESCRIPTION OF THE PREFERRED EMBODIMENT

Figure 5:
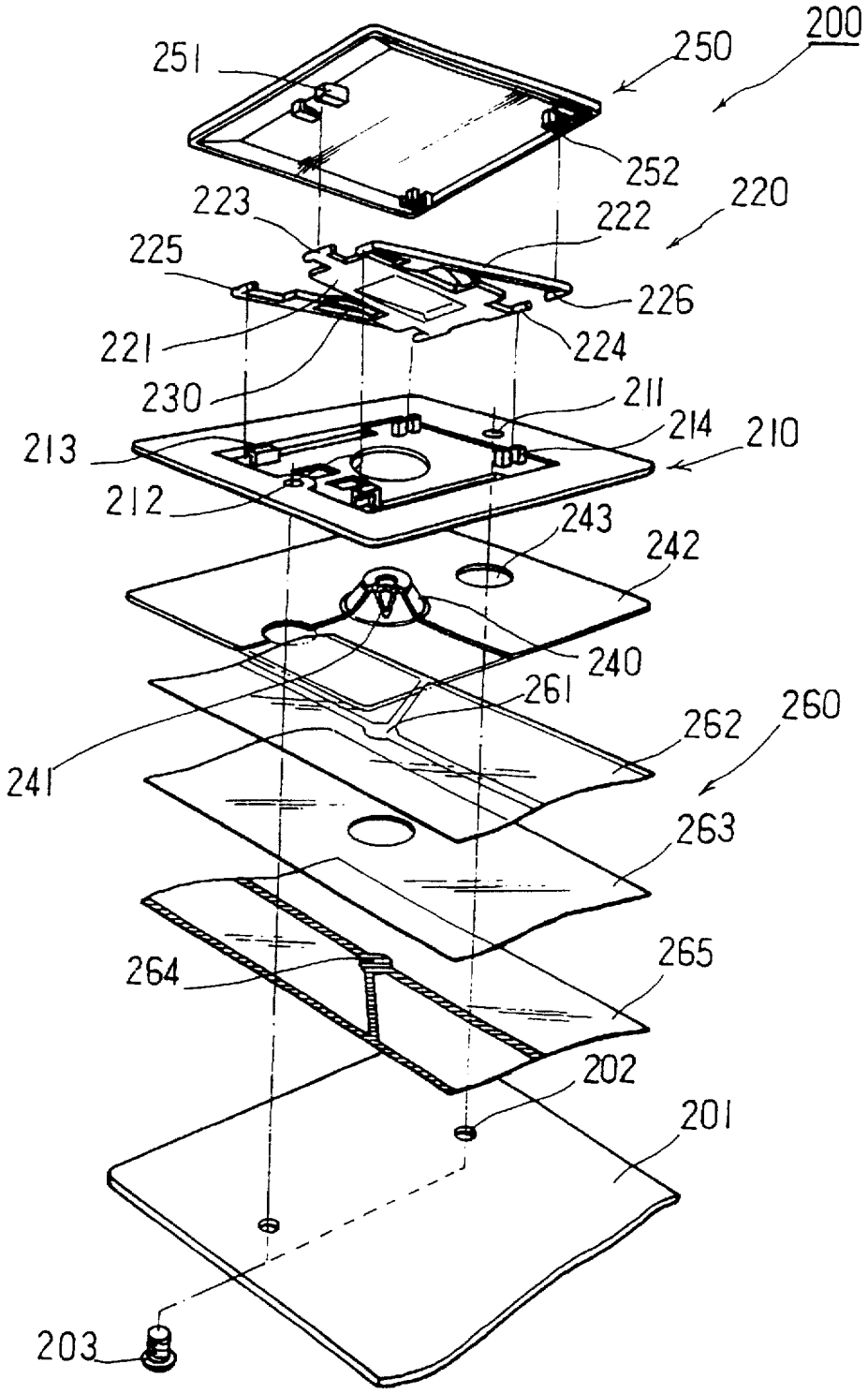
FIG. 5 is an exploded perspective view of the key board according to the present invention.

FIG. 5 is an exploded perspective view of the key board according to the present invention. FIG. 6A is a plan view showing the key board according to the present invention. FIG. 6B is a sectional view taken along a line C—C of FIG. 6A.

The key board according to the present invention includes: a key frame 210 installed upon a backing board 201; a key top 250 with guide pieces installed thereon; a link plate 220 disposed between the key top 250 and the key frame 210, for guiding and supporting the upward and downward actuations of the key top 250; actuation rubbers 240 disposed under the link plate 220 so as to make the upward and downward actuations of the key top 250 possible; and a switching part 260 for causing a movable contact 261 and a fixed contact 264 to be contacted by the help of a protuberance 241 of the actuation rubbers 240.

The key frame 210 is constituted as follows. That is, the backing board 201 has two through holes 202, and fastening bolts 203 passing through the through holes 202 are fastened into fastening holes 211 of the key frame 210.

The switching part 260 includes: an upper sheet 262 with a movable contact 261 printed thereon; a guide sheet 263 disposed thereunder; and a lower sheet 265 with a fixed contact printed thereon, the above three sheets being stacked in the mentioned sequence. The switching part 260 is installed between the backing board 201 and the key frame 210 so that the movable contact 261 would be contacted with the fixed contact 264, if the inner protuberance 241 of the actuation rubbers 240 presses the movable contact 261.

Between the key frame 210 and the backing board 201 and upon the switching part 260, there is disposed an actuation rubber sheet 242 on which a plurality of actuation rubbers 240 are arranged in accordance with the circuit pattern of a whole key board (not shown). When fastening the actuation rubber sheet 242 between the key frame 210 and the backing board 201, the fastening bolts 203 pass through through-holes 243 of the actuation rubber sheet 242.

FIGS. 8A and 8B are plan and frontal views of the key frame of the key board according to the present invention.

The key fame 210 includes: a through hole 212 at the center thereof, for receiving the actuation rubbers 240; fastening holes 211 formed near left and right edges thereof, for threadably receiving the fastening bolts 203; first guide pieces 213 formed upon and on one side region of the key frame 210, for slidably coupling with first supporting pieces 225 of a second link member 222 of the link plate 220; and second guide pieces 214 formed on another side region thereof, for rotatably coupled with second supporting parts 224 of a first link part 221 of the link plate 220.

FIG. 7A is a plan view of an integral link member for guiding and supporting the upward and downward actuations of the key top in the key board according to the present invention. FIG. 7B is a frontal view of the link plate of the key board according to the present invention. FIG. 7C illustrates the critical portion, i.e., a connecting plate of the link plate of the key board according to the present invention.

The link plate 220 which is integrally injection-molded for guiding and supporting the upward and downward actuations of the key top 250 includes:

a first link part 221 including: a first supporting part 223 formed on one end thereof, for being slidably coupled with first guide pieces 251 of the key top 250; second supporting parts 224 formed at another end thereof; and a protuberance 231 formed on an outer rear side thereof, and integrally connected to a connecting plate 230; and a second link part 222 including: first supporting pieces 225 formed at the rear of the first link part 221 and projected inwardly therefrom, for being slidably coupled with first guide pieces 213 of the key frame 210; second supporting pieces 226 projected from another end, for being rotatably coupled with second guide pieces 252 of the key top 250; and protuberances 232 formed near front end and on the inside integrally with the connecting plate 230. The first link part 221 and the second link part 222 are integrally connected together through the connecting plate 230. Between the connecting plate 230 and the first and second link parts 221 and 222, there are gaps 233 for facilitating the elastic actuation of the link plate 220.

As shown in FIG. 9, on a side region of the bottom of the key top 250, there are formed first guide pieces 251 for being slidably coupled with the first supporting part 223 of the first link part 221. On another side region, there are second guide pieces 252 for being rotatably coupled with the second supporting pieces 226 of the second link part 222 of the link plate 220.

The key board of the present invention constituted as above will now be described as to its actuation.

As shown in FIGS. 5 to 9, correspondingly with the fastening holes 211 of the key frame 210 of the key board 200, the backing board 201 is provided with through holes 202. Above the backing board 201, there is disposed a switching part 260 at each key of the key board. Above the switching part 260, there is disposed an actuation rubber sheet 242 on which a plurality of actuation rubbers 240 are projected upward to be inserted through the through hole 212 of the key frame 210.

Further, the fastening bolts 203 which first pass through the backing board 201 toward the actuation rubber sheet 242 are fastened into the fastening holes 211 of the key frame 210 to fix the switching part 260 and the actuation rubber 240.

By using the actuation rubber sheet 242, the assembling process steps are significantly decreased during the assembling of the key board in which a plurality of keys are installed. Even if the installation positions of the keys are modified in accordance with the layout of the key board, the assembling becomes easy.

Further, the switching part 260 and the actuation rubbers 240 are disposed upon the backing board 201, so that the integral link plate 220 would be connected between the key frame 210 and the key top 250, thereby making the upward and downward actuations of the key top 250 parallel and smooth.

On the both of the edge portions of the key frame 210, there are installed the first and second guide pieces 213 and 214, and therefore, the first supporting pieces 225 of the second link part 222 of the link plate 220 are coupled with the first guide pieces 213, so that they can be slidably actuated during the actuations of the key top 250. The second supporting parts 224 of the first link part 221 of the link plate 220 are coupled with the second guide pieces 214, so that they can be rotatably actuated during the actuation of the key top 250.

The connecting plate 230 which integrally connects the first link part 221 to the second link part 222 is a thin sheet having a thickness of 0.1–0.3 mm, preferably 0.2 mm. If the thickness of the connecting plate 230 is larger than 0.3 mm, the user feels less touching sensation (pressing sensation), while if its thickness is less than 0.1 mm, the manufacture becomes impossible.

Further, the link plate 220 includes the first and second link parts 221 and 222 integrally connected through the connecting plate 230, and the upward and downward actuations are possible in a crossing manner owing to the elasticity of the connecting plate 230. Therefore, the assembling becomes easier.

Further, the first supporting part 223 and the second supporting pieces 226 are respectively formed on the first link part 221 and the second link part 222 of the link plate 220. Therefore, the first supporting part 223 is fitted into between the first guide pieces 251 of the key top 250, and therefore, the first supporting part 223 performs sliding actuations during the upward and downward actuations of the key top 250. The second supporting pieces 226 are coupled with the second guide pieces 252 of the key top 250, so that they can perform rotating actuations during the upward and downward actuations of the key top 250.

Further, the second supporting parts 224 and the first supporting pieces 225 are respectively formed on the first link part 221 and the second link part 222 of the link plate 220. Therefore, the first supporting pieces 225 are fitted to the first guide pieces 213 of the key frame 210, and therefore, they perform sliding actuations during the upward and downward actuations of the key top 250. The second supporting parts 224 are coupled with the second guide pieces 214 of the key frame 210, so that they can perform rotating actuations during the upward and downward actuations of the key top 250.

Therefore, the respective supporting parts 223 and 224 and the supporting pieces 225 and 226 of the link plate 220 are coupled with the guide pieces 213, 214, 251 and 252 of the key frame 210 and the key top 250, so that one group would perform rotating actuations, and that the other group would perform sliding actuations. Therefore, even if the user presses only a part of the key top 250, the pressing force is propagated to the entire link plate 220, and consequently, the key top 250 can perform smooth upward and downward actuations all the time.

Accordingly, owing to the use of the integral actuation rubber sheet 242 and the integral link plate 220, the structure of the key board 200 is simplified, with the result that the workability and the productivity are improved owing to the easy assemblability. Further, owing to the short actuation strokes of the link plate 220, the height of the key board 200 is reduced to the minimum, thereby making it possible to form a thin key board. At the same time, the touching sensation of the user is maintained in a good state.

According to the present invention as described above, the link plate which is installed between the key top and the key frame is provided in an integral form. Therefore, even if the user presses only a part of the key top, the vertical actuations of the key top becomes smooth and perfect owing to the smooth vertical movements of the link plate. Further, the vertical actuation strokes of the key top together with the integral link plate are maintained at a constant level. Further, the plurality of the actuation rubbers are formed integrally on the actuation rubber sheet, so that the key board can be made thin. Further, owing to the integral link plate, the structure of the key board is simplified. Consequently, the manufacture of the key board becomes easy, and the assembling process steps are reduced, thereby making it possible to improve the workability and the productivity.

In the above, the present invention was described based on the specific preferred embodiment, but it should be apparent to those ordinarily skilled in the art that various changes and modifications can be added without departing from the spirit and scope of the present invention.

What is claimed is:

1. A key board comprising:

a key top (250) having first guide pieces (251) and second guide pieces (252) installed thereon;

a key frame (210) installed in opposing facing relation to said key top (250) with said guide pieces formed therebetween;

an actuation rubber sheet (242) having an actuation rubber (240) arranged integrally thereon to transmit upward and downward actuating movement of said key top (250) to a switching part (260);

a movable contact (261) and a fixed contact (264) respectively disposed on opposite sides of said switching part (260) and being contactable with each other through the switching part (260) by movement of said actuation rubber (240); and a link plate (220) disposed between said key top (250) and said key frame (210), and having a connecting plate (230) integrally and movably connecting a first link part (221) to a second link part (222) thereof, wherein said connecting plate (230) and said first and second link parts (221, 222) are integrally formed as a one-piece unit.

2. A key board comprising:

a key top (250) having first guide pieces (251) and second guide pieces (252) installed thereon;

a key frame (210) installed in opposing facing relation to said key top (250) with said guide pieces formed therebetween;

an actuation rubber sheet (242) having an actuation rubber (240) arranged integrally thereon to transmit upward and downward actuating movement of said key top (250) to a switching part (260);

a movable contact (261) and a fixed contact (264) respectively disposed on opposite sides of said switching part (260) and being contactable with each other through the switching part (260) by movement of said actuation rubber (240);

a link plate (220) disposed between said key top (250) and said key frame (210), and having a connecting plate (230) integrally connecting a first link part (221) to a second link part (222) thereof, wherein said connecting plate (230) and said first and second link parts (221, 222) are integrally formed as a one-piece unit;

said first link part 221 includes first and second supporting parts (223) and (224) respectively formed on opposite ends thereof, and a protuberance (231) formed on an outer rear side thereof and integrally connected to said connecting plate (230); and said second link part 222 includes first and second supporting pieces (225) and (226) respectively projecting inward from opposite ends thereof, and protuberances (232) formed on insides thereof for connecting said second link part (222) to said connecting plate (230).

3. The key board as claimed in claim 2 wherein said key frame (210) includes first and second guide pieces (213) and (214) formed thereon, and wherein said first supporting parts (223) are coupled to the first guide pieces (251) of said key top (250) and the second supporting parts (224) are coupled to the second guide pieces (214) of said key frame (210) to respectively perform sliding and rotating actuations upon pressing of said key top (250), and wherein said first supporting pieces (225) are coupled to said first guide pieces (213) of said key frame (210) and said second supporting pieces (226) are coupled to said second guide pieces (252) of said key top (250) to respectively perform sliding and rotating actions.

4. A key board comprising:

a key top (250) having first guide pieces (251) and second guide pieces (252) installed thereon;

a key frame (210) installed in opposing facing relation to said key top (250) with said guide Pieces formed therebetween;

an actuation rubber sheet (242) having an actuation rubber (240) arranged integrally thereon to transmit upward and downward actuating movement of said key top (250) to a switching part (260);

a movable contact (261) and a fixed contact (264) respectively disposed on opposite sides of said switching part (260) and being contactable with each other through the switching part (260) by movement of said actuation rubber (240);

a link plate (220) disposed between said key top (250) and said key frame (210), and having a connecting plate (230) integrally connecting a first link part (221) to a second link part (222) thereof, wherein said connecting plate (230) and said first and second link parts (221, 222) are integrally formed as a one-piece unit;

said first link part 221 includes first and second supporting parts (223) and (224) respectively formed on opposite ends thereof, and a protuberance (231) formed on an outer rear side thereof and integrally connected to said connecting plate (230);

said second link part 222 includes first and second supporting pieces (225) and (226) respectively protecting inward from opposite ends thereof, and protuberances (232) formed on insides thereof for connecting said second link part (222) to said connecting plate (230); and said connecting plate (230) integrally connected between said first and second link parts (221) and (222) of said link plate (220) has a thickness thinner than those of said first and second link parts (221) and (222), for making said first and second link parts (221) and (222) perform elastic actuations.

5. The key board as claimed in claim 1, further comprising a backing board (201) to which the key frame (210) is mounted, wherein said switching part (260) disposed between said key frame (210) and said backing board (201) includes said actuation rubber sheet (242) with a plurality of said actuation rubbers (240) arranged thereon in an integral form.

* * * * *